US005282888A

United States Patent [19]

Fukawa et al.

[11] Patent Number: 5,282,888

[45] Date of Patent: Feb. 1, 1994

[54] HOLDING APPARATUS FOR A DIP COATING APPARATUS

[75] Inventors: Yoichi Fukawa; Hiromitsu Uchimoto, both of Kanagawa, Japan

[73] Assignee: Fuji Xerox Co., Ltd., Tokyo, Japan

[21] Appl. No.: 758,843

[22] Filed: Sep. 13, 1991

[30] Foreign Application Priority Data

Sep. 17, 1990 [JP] Japan ..... 2-096572[U]

[51] Int. Cl.[5] ..... B05C 3/02

[52] U.S. Cl. ..... 118/500; 118/423; 118/428; 269/48.1; 269/27; 279/2.17; 294/93

[58] Field of Search ..... 118/423, 428, 500, 503; 269/27, 47, 48.1, 48.3; 279/2.1, 2.17; 294/93, 98.1

[56] References Cited

U.S. PATENT DOCUMENTS

| | | | |
|---|---|---|---|
| 1,371,082 | 3/1921 | Erickson | 118/503 |
| 2,233,070 | 2/1941 | Atwell et al. | 118/503 |
| 3,118,791 | 1/1964 | McLean | 118/503 |
| 3,331,723 | 7/1967 | Grace et al. | 269/48.1 |
| 3,844,546 | 10/1974 | Greenberg | 269/48.1 |
| 3,945,486 | 3/1976 | Cooper | 118/503 |
| 4,106,783 | 8/1978 | Glimpel | 269/48.1 |
| 4,168,073 | 9/1979 | LaRue | 279/2.17 |
| 4,465,220 | 8/1984 | Ledlow et al. | 269/48.1 |
| 4,767,125 | 8/1988 | Barry et al. | 269/48.1 |
| 5,072,953 | 12/1991 | Griffiths | 269/48.1 |
| 5,090,608 | 2/1992 | Jones | 269/48.1 |

FOREIGN PATENT DOCUMENTS

| | | | |
|---|---|---|---|
| 1109466 | 6/1961 | Fed. Rep. of Germany | 269/48.1 |
| 3323306 | 12/1983 | Fed. Rep. of Germany | 118/503 |
| 203490 | 10/1983 | German Democratic Rep. | 269/48.1 |
| 59-4466 | 1/1984 | Japan . | |
| 62-241578 | 10/1987 | Japan . | |
| 63-20068 | 1/1988 | Japan . | |
| 63-264166 | 11/1988 | Japan . | |

*Primary Examiner*—W. Gary Jones
*Assistant Examiner*—Todd J. Burns
*Attorney, Agent, or Firm*—Finnegan, Henderson, Farabow, Garrett & Dunner

[57] ABSTRACT

The present invention provides an apparatus for holding a hollow cylindrical body with openings at both ends during a dip coating apparatus having a flange member, a first pressing member fastened to the flange member, a shaft member extending from the flange member in the direction of the first pressing member, a second pressing member fastened to the shaft member, a flexible bag member located between the first pressing member and the second pressing member, and means for moving the shaft member in a direction of the shaft to move the first pressing member to cause the flexible bag member to expand laterally to contact the inside of the hollow cylindrical body to hold the hollow cylindrical body.

4 Claims, 1 Drawing Sheet

HOLDING APPARATUS FOR A DIP COATING APPARATUS

BACKGROUND OF THE INVENTION

1. Field of the Invention

The present invention relates to a holding apparatus for dip coating apparatus which is used to seal an opening of a hollow cylindrical body used as photoreceptor in an electrophotographic copying machine, for example, and to hold the hollow cylindrical body during dipping and coating of an outer surface of the hollow cylindrical body.

2. Discussion of the Related Art

Conventionally, a dip coating method has been considered desirable in coating the outer surface of a hollow cylindrical body or the like, and especially in the case where the smoothness of the film coating is thought to be important. For example, a dip coating method is often employed to form a photoconductive layer on the hollow cylindrical body utilized as a photoreceptor in an electrophotographic copying machine.

In the conventional dip coating method, a hollow cylindrical body is first dipped into the coating solution and is then pulled up at a selected speed. If the hollow cylindrical body is open at its upper and lower ends, the coating solution enters inside the hollow cylindrical body. The inner surface of the hollow cylindrical body is also coated by the coating solution, which will waste the coating solution, and also may cause pollution in the copying machine and difficulty in drying the inner surface of the hollow cylindrical body.

So far various devices have been suggested in order to solve the aforementioned problems. For example, one apparatus blocks the inside of the hollow cylindrical body by using an expanding and contracting air tight bag is disclosed by Japanese Patent Application Unexamined Publication No. Sho. 59-4466. Further, Japanese Patent Application Unexamined Publication No. Sho. 62-241578 provides an apparatus for holding and sealing the upper end of the hollow cylindrical body by pressing a flexible O ring.

An apparatus having a holding member to hold a hollow cylindrical body by frictional contact with its inner surface as it is pulled up by a lifting member is disclosed by Japanese Patent Application Unexamined Publication No. Sho. 63-20068. Moreover, Japanese Patent Application Unexamined Publication No. Sho. 63-264166 shows an apparatus for sealing and holding the upper end of the hollow cylindrical body by pressing various forms of elastic bodies.

However, the above-mentioned proposed devices so far are unsatisfactory. The apparatus disclosed in Japanese Patent Application Unexamined Publication No. Sho. 59-4466 has a problem that a rubber film is liable to be damaged by fatigue due to expansion and contract of the rubber film by pressurized air, and it is difficult to control expansion while many other devices are also being operated simultaneously. The problems with the apparatus disclosed by Japanese Patent Application Unexamined Publication No. Sho. 62-241578 are that the upper end of the hollow cylindrical body cannot be completely sealed and held because an inner diameter of the hollow cylindrical body and the O ring have a low degree of freedom and there is difficulty in controlling the attitude of the hollow cylindrical body while it is being held. Further, an outer surface of the O ring is easily worn out, and the O ring must be exchanged whenever the size of the inner diameter of the hollow cylindrical body changes. A solution of these problems is to enlarge the O ring, but in this case, excessive force is needed to press the O ring, and the force may cause deformation of the hollow cylindrical body.

If a sponge-like elastic body is used as the O ring, oil bleeds from the inside of the elastic body and adheres to a holding portion inside of the hollow cylindrical body because of the excessive pressing force; therefore the hollow cylindrical body sometimes does not separate from the elastic body even after pressing is suspended. Moreover, oil bled from the inside of the elastic body deteriorates the coating solution.

In order to solve the above-mentioned problems, Japanese Patent Application Unexamined Publication No. Sho. 63-264166 provides an apparatus, which improves sealing and holding by using relatively large-sized elastic bodies of various forms. However, the apparatus has a complex form and needs a large compression force and a long compression stroke. Moreover, the manufacturing cost is rather high. There are also problems in controlling the attitude of the hollow cylindrical body because it cannot be perfectly controlled if a position of the hollow cylindrical body before being held was shifted from a predetermined position because of pressing an opening portion of the hollow cylindrical body to a fixed flange. Also, it has a low ability for attitude control the hollow cylindrical body is held only by its upper end. Another problem sometimes appears that the elastic body maintains contact with the hollow cylindrical body and cannot separate therefrom because repetition of expansion and contraction of the elastic body causes fatigue that prevents resumption of the original form.

The apparatus disclosed by Japanese Patent Application Unexamined Publication No. Sho. 63-20068 has a problem that entire sealing and holding mechanisms must be exchanged whenever the size of the inner diameter of the hollow cylindrical body changes.

SUMMARY OF THE INVENTION

The present invention has been made in view of the above circumstances and has as an object to provide a hollow cylindrical body holding apparatus for a dip coating apparatus which can hold the body with certainty and be separated from the body without deformation or damage.

Other objects of the present invention are to provide a hollow cylindrical body holding apparatus that is smaller, less expensive, more durable, and can easily adapt to changes in the size of the hollow cylindrical body.

A further object of the present invention is to increase the reliability of the hollow cylindrical body in an exact position with regard to both the longitudinal direction and a direction orthogonal thereto.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, embodied and broadly described herein, the holding apparatus, of this invention comprises a flange member, a first pressing member fastened to the flange member, a shaft member extending from the flange member in a direction of the first pressing member, a second pressing member fastened to the shaft member, a flexible bag member located between the first pressing member and the second pressing member and means for moving the shaft member in the direction of the shaft to move the first pressing member relative to the second pressing member to cause the flexible bag member to expand laterally to contact the inside of the hollow cylindrical member to hold the hollow cylindrical member.

BRIEF DESCRIPTION OF THE DRAWINGS

The accompanying drawings, which are incorporated in and constitute a part of this specification illustrate embodiments of the invention and, together with the description, serve to explain the objects, advantages, and principles of the invention. In the drawings.

DETAILED DESCRIPTION OF THE PREFERRED EMBODIMENTS

Figure 1:
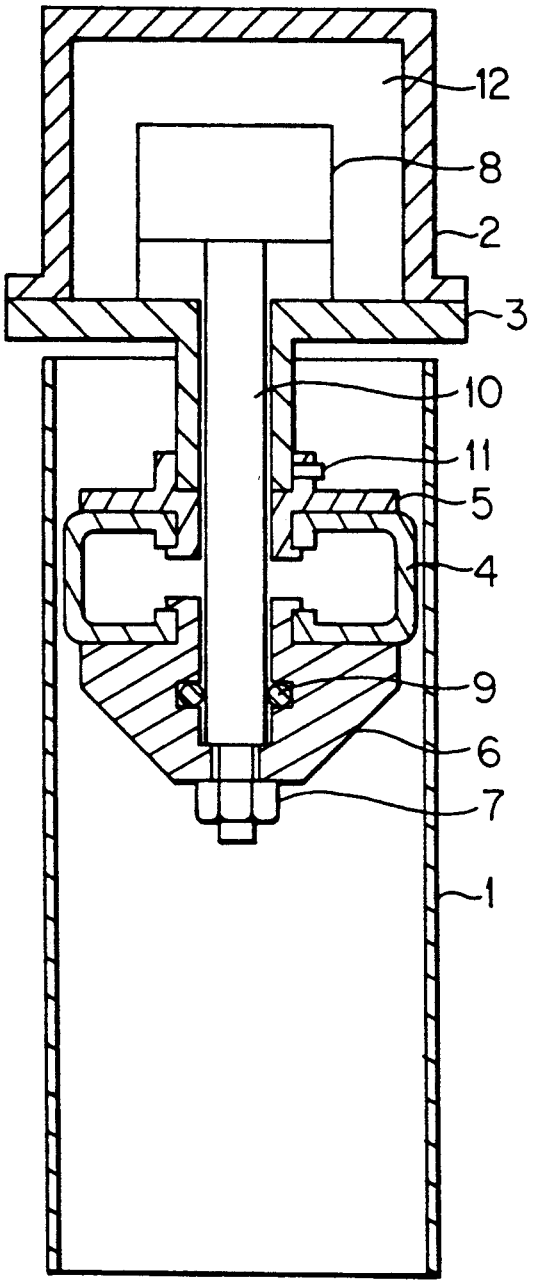
FIGS. 1 and 2 are schematic sectional views showing the holding apparatus of an embodiment of the present invention.
Figure 2:
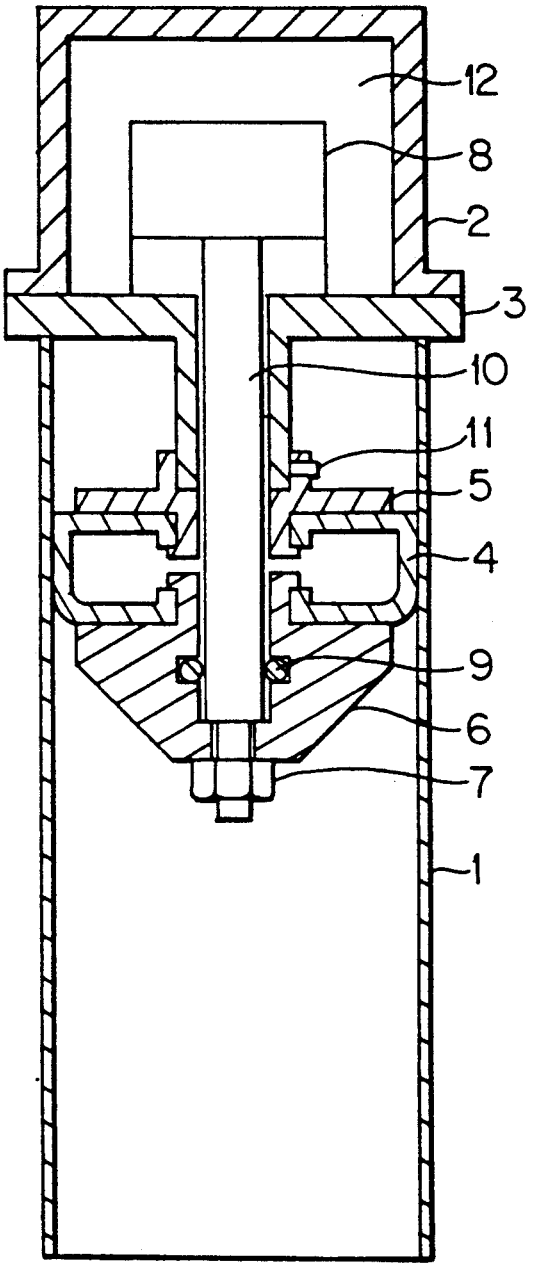

A preferred embodiment of the present invention will be described in detail based on the drawings. FIGS. 1 and 2 are schematic sectional views showing the embodiment of the present invention. FIG. 1 and FIG. 2 respectively show the state before the hollow cylindrical body is held and the state where the hollow cylindrical body is being held.

The hollow cylindrical body holding apparatus of the present invention includes a holding member 2 movable up-and-down by means of an apparatus which is not shown in the drawings. A flange member 3 is fastened to the holding member 2 to form an air chamber 12. An air cylinder 8 is installed on the flange member 3 and inside of the air chamber 12. A shaft 10 of the air cylinder 8 is supported by the flange member 3 to be movable up-and-down, and a flexible bag member 4, an upper side keep plate 5, and a lower side keep plate 6 are detachably attached to a bottom portion of the flange member 3. The upper side keep plate 5 is fastened to the lower end of the flange member 3 by a setscrew 11 and the lower side keep plate 6 is fastened in the vicinity of the lower end of the shaft 10 by a nut 7. It is desirable that the distance between the flange member 3 and the upper side keep plate 5 be as long as possible from the viewpoint of holding the attitude of the hollow cylindrical body. However, if the manufacturing cost is taken into consideration, a proper distance may be 10–100 mm for a 300 mm long hollow cylindrical body.

The flexible bag member may comprise soft plastic, rubber, or the like. An upper part of the flexible bag member 4 is engaged with, and fastened to, the upper side keep plate 5 and a lower part of the flexible bag member 4 is engaged with, and fastened to, the lower side keep plate 6. The flexible bag member may be exchanged with different size bags by removing the nut 7 and the setscrew 11 to accommodate the size of the inner diameter of the hollow cylindrical body 1. Because the apparatus in the present invention is small-sized, it is possible to engage two flexible bag members having different diameters with the shaft 10 simultaneously.

The dip coating method using the holding apparatus according to the present invention is preferably practiced as follows. First, the holding member 2 is moved downward by means of the apparatus not shown in FIG. 1 to insert the flexible bag member 4 into the hollow cylindrical body, as shown in the FIG. 1. Then, the air cylindrical 8 is operated to move the shaft 10 upward so that the lower side keep plate 6 is lifted. Because the upper side keep plate 5 is fixed and the lower side keep plate 6 is moved in the direction of the upper side keep plate 5, the flexible bag member 4 is compressed between the upper side keep plate 5 and the lower side keep plate 6. As a result, the flexible bag member 4 is uniformly pushed out in the cross direction, i.e., expands laterally, and contacts the inner peripheral surface of the hollow cylindrical body 1 as shown in the FIG. 2. The flexible bag member 4 somewhat deformed upwardly after it contacts the inner peripheral surface of the hollow cylindrical body 1, and the upper end of the hollow cylindrical body 1 is slightly pressed against the flange member 3. In this manner, the hollow cylindrical body 1 is held in a fixed position. Moreover, if the axis of the hollow cylindrical body 1 and the axis of the hollow cylindrical body holding apparatus do not coincide with each other, the axes are automatically aligned to be colinear owing to the uniform deformation of the flexible bag member 4 in the cross direction.

The lifting force of the air cylinder 8 is properly selected depending on the form, thickness, and the diameter of the hollow cylindrical body 1. For example, about 15 kgf of lifting force is sufficient to support a hollow cylindrical body with a 43 mm inner diameter and a 2 mm thickness. The hollow cylindrical body 1 is not deformed by the lifting force of that magnitude.

If the distance between the hollow cylindrical body 1 and the flange member 3 before the hollow cylindrical body 1 is held is not more than 2 mm, as shown in FIG. 1, no trouble occurs because the hollow cylindrical body 1 is aligned to the center axis of the holding member 2, and the upper end of the hollow cylindrical body 1 will engage the flange member 3 as the air cylinder 8 is operated. The hollow cylindrical body 1 will be held at a fixed position regardless of how little space is provided between the hollow cylindrical body 1 and the flange member 3.

The hollow cylindrical body 1 held as described above is sealed at the upper end of the body by the flange member at the same time it is held so that the inside of the hollow cylindrical body becomes airtight when it is immersed in a coating solution tank. Therefore, coating solution will not flow in to the inside of the hollow cylindrical body because of air trapped inside the cylinder. Consequently, the coating film is formed only on the outside surface of the hollow cylindrical body as the hollow cylindrical body is lifted from the coating solution tank.

An O ring 9 maybe installed at the lower part of the shaft 10 to prevent air from bleeding. In this case, it is desirable that the shaft 10 be hollow, and that the air chamber 12 communicates with the inside of the hollow cylindrical body through the hollow shaft. Then, any rise of the pressure inside of the hollow cylindrical body by the vapor pressure of solvent contained in the coating solution can be moderated because the capacity of the hollow cylindrical body becomes larger; consequently bubbles will not be generated near the lower end of the hollow cylindrical body and the uniformity of the coating film is preserved. Further, if the vapor pressure of the coating solution is likely to rise, the generation of bubbles can be prevented by floating a float, as disclosed in copending application Ser. No, 272,284, filed on Nov. 17, 1988 now Pat. No. 5,185,187, and assigned to the same assignee as the instant invention.

After the dip coating process is finished, the lower side keep plate is pulled down by operating the air cylinder 8, accordingly the flexible bag member is stretched in the up-and-down direction and the hollow cylindrical body and the flexible bag member separate from each other. Then, the hollow cylindrical body is easily detached from the holding apparatus.

The foregoing description of a preferred embodiment of the invention has been presented for purpose of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An apparatus for holding a hollow cylindrical body with openings at both ends during a dip coating process, the apparatus comprising:

a flange member having a central hollow cylinder insertable into the hollow cylindrical body and a base formed around and perpendicular to one end of the hollow cylinder;

a housing secured to the base of said flange member to form a fluid chamber;

a first pressing member fastened to the hollow cylinder of said flange member;

a shaft member extending through the hollow cylinder of said flange member, wherein said shaft member is hollow to allow fluid to pass through the hollow shaft member and into the fluid chamber during the dip coating process;

a second pressing member fastened to said shaft member;

a fluid-filled flexible bag member located between said first pressing member and said second pressing member; and means of moving said shaft member to move said first pressing member relative to said second pressing member to cause said flexible bag member to expand laterally to contact the inside of said hollow cylindrical body to hold said hollow cylindrical body.

2. The holding apparatus according to claim 1, wherein said flexible bag member is fastened to said first pressing member and said second pressing member.

3. The holding apparatus according to claim 1, further comprising:

means for detachably fastening said first pressing member to said flange member and for detachably fastening said second pressing member to said shaft member.

4. The holding apparatus according to claim 1, wherein said means for moving said shaft member comprises a fluid cylinder located inside of said fluid chamber.

* * * * *

UNITED STATES PATENT AND TRADEMARK OFFICE

CERTIFICATE OF CORRECTION

PATENT NO. : 5,282,888

DATED : February 01, 1994

INVENTOR(S) : Yoichi Fukawa et al.

It is certified that error appears in the above-indentified patent and that said Letters Patent is hereby corrected as shown below:

Claim 1, column 6, line 15, change "means of moving" to --means for moving--.

Signed and Sealed this

Fourth Day of October, 1994

Bruce Lehman

*Attest:*

BRUCE LEHMAN

*Attesting Officer*

*Commissioner of Patents and Trademarks*